US010030659B2

(12) United States Patent
Tanaka

(10) Patent No.: US 10,030,659 B2
(45) Date of Patent: Jul. 24, 2018

(54) VACUUM PUMP

(71) Applicant: Toyota Jidosha Kabushiki Kaisha, Toyota-shi (JP)

(72) Inventor: Mirai Tanaka, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 260 days.

(21) Appl. No.: 14/979,402

(22) Filed: Dec. 27, 2015

(65) Prior Publication Data

US 2016/0298628 A1 Oct. 13, 2016

(30) Foreign Application Priority Data

Apr. 9, 2015 (JP) ..... 2015-080128

(51) Int. Cl.

| | |
|---|---|
| ***F04C 29/02*** | (2006.01) |
| ***F04C 29/00*** | (2006.01) |
| ***F04C 25/02*** | (2006.01) |
| ***F04C 18/344*** | (2006.01) |

(52) U.S. Cl.

CPC ..... *F04C 29/021* (2013.01); *F04C 18/3441* (2013.01); *F04C 25/02* (2013.01); *F04C 29/005* (2013.01); *F04C 29/025* (2013.01)

(58) Field of Classification Search

CPC .... F04C 29/021; F04C 29/005; F04C 29/025; F04C 18/3441; F04C 25/02

USPC ..... 418/84, 88, 98

See application file for complete search history.

(56) References Cited

U.S. PATENT DOCUMENTS

2008/0232981 A1 9/2008 Zhou
2012/0294740 A1 11/2012 Maruyama et al.

FOREIGN PATENT DOCUMENTS

EP 1 972 785 A1 9/2008
JP 2008-157070 7/2008
WO WO 2011/092930 A1 8/2011

OTHER PUBLICATIONS

Office Action dated May 30, 2017 in Japanese Patent Application No. 2015-080128.

*Primary Examiner* — Laert Dounis
*Assistant Examiner* — Kelsey Stanek
(74) *Attorney, Agent, or Firm* — Oblon, McClelland, Maier & Neustadt, L.L.P.

(57) ABSTRACT

A vacuum pump includes a rotor and a housing, which define a vacuum chamber. Rotation of the rotor generates negative pressure in the vacuum chamber. The vacuum pump includes an oil introduction passage, which is connected to an oil pump to introduce oil into the vacuum pump, and an atmosphere communication passage, which opens in the atmosphere to introduce air into the vacuum pump. The vacuum pump further includes a valve and a spring, which serve as a communication control mechanism. The communication control mechanism provides communication between the vacuum chamber and the oil introduction passage and closes the atmosphere communication passage when the vacuum pump is driven. The communication control mechanism provides communication between the vacuum chamber and the atmosphere communication passage and closes the oil introduction passage when the vacuum pump is stopped.

3 Claims, 5 Drawing Sheets

VACUUM PUMP

BACKGROUND OF THE INVENTION

The present invention relates to a vacuum pump that generates negative pressure.

A vacuum pump has been known that includes a rotor and a housing, which accommodates and rotationally supports the rotor. Japanese Laid-Open Patent Publication No. 2008-157070 discloses an example of such a vacuum pump. The rotor of the vacuum pump is coupled to a camshaft of an internal combustion engine and thus rotates integrally with the camshaft. Rotation of the rotor changes the volume of the space in the housing and generates negative pressure.

The vacuum pump of the '070 publication includes an oil supply pipe located in the coupling section between the rotor and the camshaft. The oil supply pipe includes a first end, which is received by the rotor, and a second end, which is received by the camshaft. The rotor includes a first oil passage that communicates with the space in the housing. The camshaft includes an oil supply hole for supplying oil to the vacuum pump. The oil supply pipe connects the first oil passage to the oil supply hole of the camshaft.

The oil supply pipe can slide in the rotor and the camshaft. The end surface of the oil supply pipe that faces the rotor is in contact with a compressed return spring. The return spring constantly urges the oil supply pipe toward the camshaft. The end surface of the oil supply pipe that faces the camshaft receives pressure of the oil supplied through the oil supply hole. When the internal combustion engine is stopped and the oil pressure applied to the end surface of the camshaft is low, the urging force of the return spring holds the oil supply pipe in the first position near the camshaft. When the internal combustion engine is operated and the oil pressure applied to the end surface of the camshaft is high, the oil pressure moves the oil supply pipe against the urging force of the return spring and holds the oil supply pipe in the second position near the rotor.

The oil supply pipe includes an atmosphere communication hole that extends through the oil supply pipe in the radial direction to provide communication between the space in the oil supply pipe and the atmosphere. Movements of the oil supply pipe bring the space in the oil supply pipe into and out of communication with the atmosphere through the atmosphere communication hole. Specifically, when the internal combustion engine and the vacuum pump are stopped, the oil supply pipe is located in the first position. In this state, the space in the oil supply pipe communicates with the atmosphere through the atmosphere communication hole. That is, when the vacuum pump is stopped, the oil supply pipe provides communication between the space in the vacuum pump and the atmosphere.

When the vacuum pump is stopped, the negative pressure remaining in the space in the housing draws oil into the housing. However, when the space in the vacuum pump communicates with the atmosphere through the atmosphere communication hole as described above, air is drawn into the housing and releases the negative pressure. This reduces the amount of oil that is drawn into and remains in the vacuum pump.

When the internal combustion engine is operated and the vacuum pump is driven, the oil supply pipe is located in the second position. The section of the oil supply pipe that includes the atmosphere communication hole is located in the rotor. Thus, the atmosphere communication hole is closed, closing communication between the space in the oil supply pipe and the atmosphere.

Since the communication between the space in the housing and the atmosphere is closed when the vacuum pump is driven, air is not drawn into the housing through the atmosphere communication hole. This limits the amount of air discharged from the vacuum pump, thereby limiting air discharge noises.

When the vacuum pump of the '070 publication is stopped, the atmosphere communication hole also provides communication between the oil supply hole and the atmosphere, allowing air to flow into the oil supply hole through the atmosphere communication hole. Thus, when supply of oil is stopped, the oil in the oil supply passage tends to be discharged by its own weight. As a result, when the internal combustion engine starts again, the vacuum pump does not receive oil until the oil supply hole is filled with oil. This prevents prompt supply of oil to the vacuum pump through the oil supply hole.

SUMMARY OF THE INVENTION

It is an objective of the present invention to provide a vacuum pump that limits the amount of oil drawn into a vacuum chamber when the vacuum pump is stopped, and promptly starts lubrication when the vacuum pump is actuated.

To achieve the above object, one aspect of the present invention is a vacuum pump that includes an oil introduction passage configured to be connected to an oil pump to introduce oil into the vacuum pump, an atmosphere communication passage that opens in the atmosphere to introduce air into the vacuum pump, and a communication control mechanism that provides communication between the vacuum chamber and the oil introduction passage and closes the atmosphere communication passage when the vacuum pump is driven. The communication control mechanism provides communication between the vacuum chamber and the atmosphere communication passage and closes the oil introduction passage when the vacuum pump is stopped.

DETAILED DESCRIPTION OF THE PREFERRED EMBODIMENTS

Referring to FIGS. 1 to 6, one embodiment of a vacuum pump according to the present invention will now be described.

Figure 1:
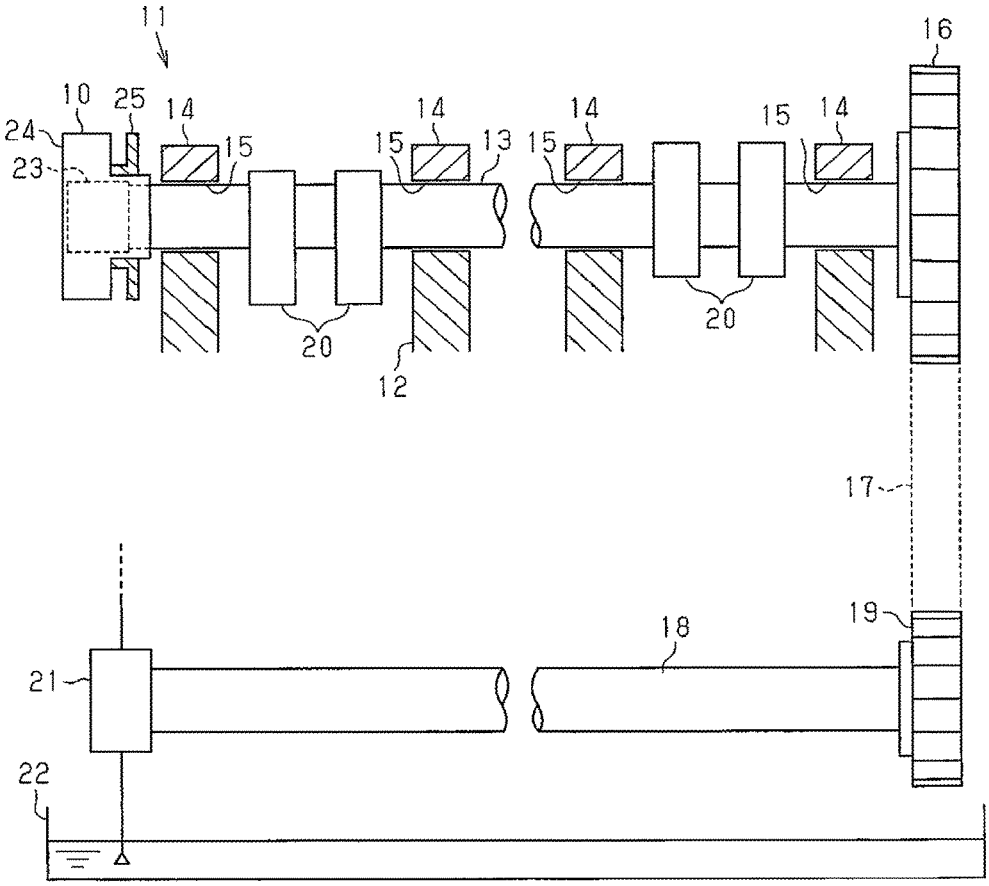
FIG. 1 is a partial schematic view showing an internal combustion engine including a vacuum pump according the present invention.

As shown in FIG. 1, a vacuum pump 10 is located in an internal combustion engine 11 that includes a plurality of shaft receiving portions 14 in the upper section of a cylinder head 12. The shaft receiving portions 14 support a camshaft 13 and each include a circular shaft receiving hole 15. The camshaft 13 is inserted through the shaft receiving holes 15 and rotationally supported by the shaft receiving holes 15.

The camshaft 13 has a first end connected to a timing pulley 16, around which a timing belt 17 is wound. The timing belt 17 is also wound around a crank pulley 19 that is connected to a first end of a crankshaft 18. Thus, when operation of the internal combustion engine 11 rotates the crankshaft 18, the camshaft 13 rotates in synchronization with the crankshaft 18.

A plurality of cams 20, which rotates integrally with the camshaft 13, is arranged on the camshaft 13. When operation of the internal combustion engine 11 rotates the camshaft 13, the cams 20 press down the engine valves.

An oil pump 21, which is driven by the engine, is connected to a second end of the crankshaft 18. When driven by rotation of the crankshaft 18, the oil pump 21 draws the oil stored in an oil pan 22 and supplies the oil to various parts of the internal combustion engine 11.

The vacuum pump 10 is located at a second end of the camshaft 13. The vacuum pump 10 includes a rotor 23 and a housing 24, which accommodates and rotationally supports the rotor 23. The rotor 23 is coupled to the camshaft 13 and thus rotates integrally with the camshaft 13. The housing 24 is fixed to a support wall 25 formed in the cylinder head 12.

Figure 2:
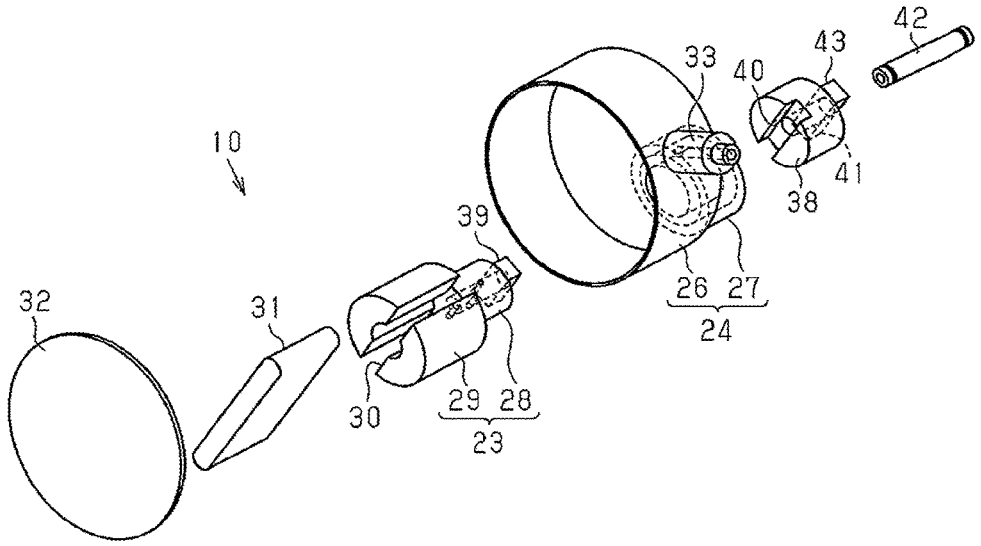
FIG. 2 is an exploded perspective view showing the vacuum pump.

Referring to FIG. 2, the structure of the vacuum pump 10 will now be described.

As shown in FIG. 2, the housing 24 is tubular and includes a receptacle 26 and a support 27, which has a smaller radial dimension than the receptacle 26. The receptacle 26 substantially has an oval cross-section, and the support 27 has a circular cross-section. The support 27 is eccentrically arranged with respect to the receptacle 26.

The rotor 23 is cylindrical and includes a shaft 28 and a sliding portion 29, which has a larger radial dimension than the shaft 28. The shaft 28 is inserted in and rotationally supported by the support 27 of the housing 24. The sliding portion 29 includes a sliding groove 30 extending in the radial direction. A vane 31 is coupled to the sliding groove 30 such that the vane 31 can slide along the sliding groove 30 in the radial direction of the rotor 23.

The vacuum pump 10 includes a cover 32, which substantially has the same shape as the cross-section of the receptacle 26 of the housing 24. When coupled to the housing 24, the vane 31 and the rotor 23 are located inside the housing 24.

Figure 3:
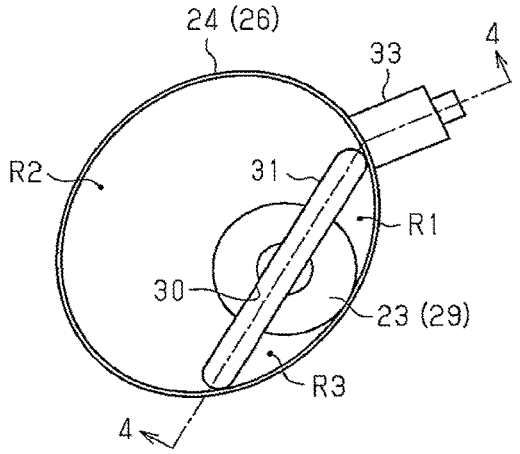
FIG. 3 is a front view showing the vacuum pump without a cover.

As shown in FIG. 3, the rotor 23 and the vane 31 that are coupled to the housing 24 define clearances R1, R2 and R3 in the receptacle 26 of the housing 24. The axis of the rotor 23 is substantially aligned with the axis of the support 27. The rotor 23 is eccentrically arranged with respect to the receptacle 26. As described above, the receptacle 26 substantially has an oval cross-section. As such, when the rotor 23 and the vane 31 rotate in the housing 24, the vane 31 slides in the sliding groove 30 with the two ends of the vane 31 in contact with the receptacle 26. The volumes of the clearances R1, R2 and R3 in the receptacle 26 are thus changed.

The housing 24 includes an inlet port 33 at the border between the clearance R1 and clearance R2 in the state shown in FIG. 3. The inlet port 33 provides communication between the space in the housing 24 and the space in the vacuum brake booster. Counterclockwise rotation of the rotor 23 from the state shown in FIG. 3 brings the clearance R1 into communication with the space in the vacuum brake booster. The rotation of the rotor 23 increases the volume of the clearance R1 and generates negative pressure in the clearance R1 accordingly. The negative pressure generated in the clearance R1 draws the air in the vacuum brake booster into the clearance R1 through the inlet port 33. This generates negative pressure in the vacuum brake booster.

Further counterclockwise rotation of the rotor 23 from the state shown in FIG. 3 closes communication between the clearance R2 and the inlet port 33. The rotation of the rotor 23 reduces the volume of the clearance R2 and compresses the air in the clearance R2 accordingly.

Figure 4:
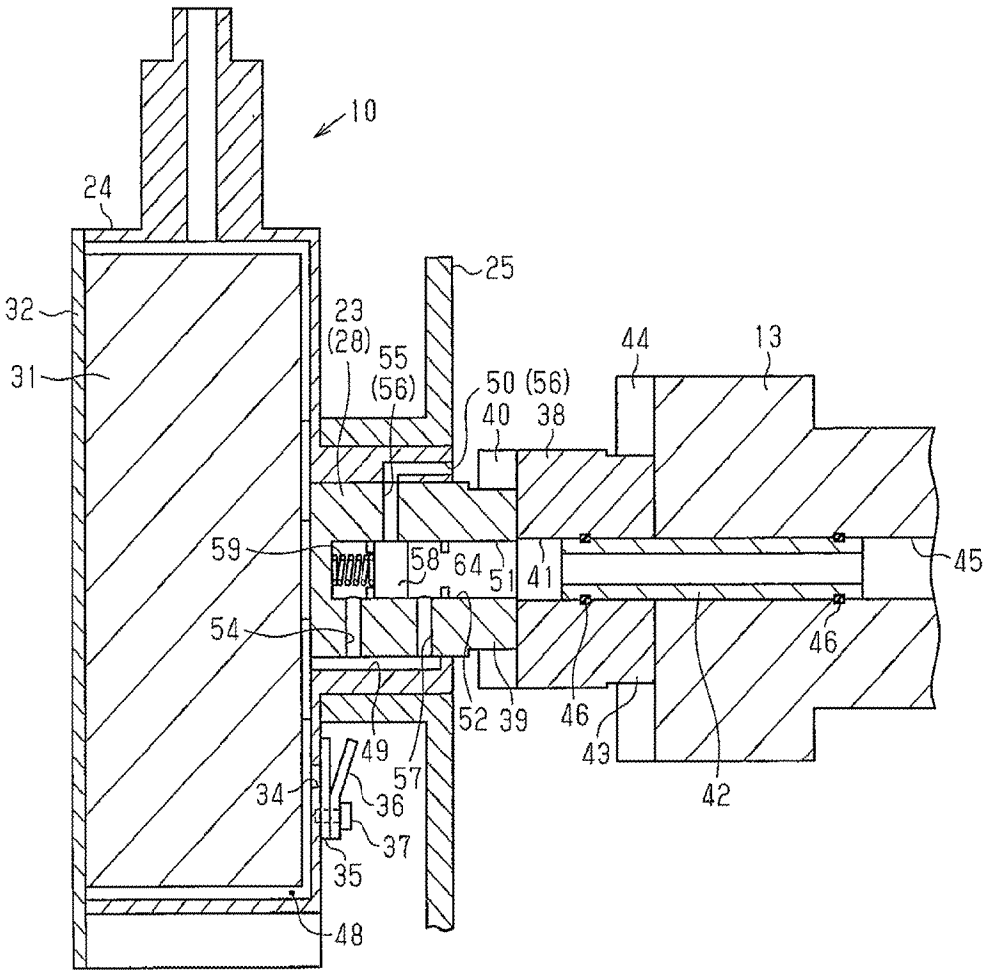
FIG. 4 is a cross-sectional view taken along line 4-4 in FIG. 3.

Further, as shown in FIG. 4, the housing 24 also includes a discharge port 34 for air. In the state shown in FIG. 3, the discharge port 34 is connected to the clearance R3. Thus, while the rotor 23 rotates counterclockwise as viewed in FIG. 3 and reduces the volume of the clearance R3, the compressed air in the clearance R3 is discharged through the discharge port 34.

As such, rotating the rotor 23 allows the vacuum pump 10 to perform an intake phase, in which air is drawn into the clearance R1 shown in FIG. 3, a compression phase, in which the drawn air is compressed in the clearance R2 shown in FIG. 3, and a discharge phase, in which the compressed air is discharged from the clearance R3 shown in FIG. 3. These phases are repeated to generate negative pressure. That is, when the vacuum pump 10 is driven, the intake phase, the compression phase, and the discharge phase are repeated in the clearances R1, R2 and R3, which are defined by the receptacle 26 of the housing 24 and the rotor 23. Each clearance functions as a vacuum chamber that generates negative pressure.

As shown in FIG. 4, a reed valve 35 is located at the discharge port 34. The reed valve 35 is a metal plate, for example, and closes the discharge port 34. A stopper 36 is placed on the reed valve 35, and the reed valve 35 and the stopper 36 are fixed to the housing 24 by a bolt 37. The stopper 36 is bent so that the upper part is farther from the reed valve 35. The section of the reed valve 35 sandwiched by the housing 24 and the stopper 36 functions as a support, and the section opposite to the support elastically deforms toward the stopper 36.

When the air in one of the clearances R1, R2 and R3 that communicates with the discharge port 34 is compressed, the increased air pressure in the clearance deforms and brings the upper end of the reed valve 35 into contact with the stopper 36. This opens the discharge port 34. When the air is discharged from the clearance and the air pressure in the clearance decreases, the reed valve 35 returns to its original position. This closes the discharge port 34. Such a structure allows for discharge of air from the housing 24 through the discharge port 34 while limiting entry of air into the housing 24 through the discharge port 34.

As shown in FIG. 4, the shaft 28 of the rotor 23 is coupled to a cylindrical coupling 38. As shown in FIG. 2, a rectangular protrusion 39 protrudes from the shaft 28 of the rotor 23. The coupling 38 includes a groove 40, which substantially has the same shape as the protrusion 39. The protrusion 39 on the shaft 28 of the rotor 23 is inserted in and engaged with the groove 40 of the coupling 38, thereby coupling the rotor 23 to the coupling 38. An insertion passage 41 extends in the coupling 38 in the axial direction.

As shown in FIGS. 2 and 4, the coupling 38 is coupled to the camshaft 13 with an oil supply pipe 42 inserted in the coupling 38. The end of the coupling 38 into which the oil supply pipe 42 is inserted includes a rectangular protrusion 43. The second end of the camshaft 13 includes a groove 44, which substantially has the same shape as the protrusion 43. The protrusion 43 of the coupling 38 is inserted into and engaged with the groove 44 of the camshaft 13, thereby coupling the coupling 38 to the camshaft 13. The coupling 38 thus couples the rotor 23 to the camshaft 13.

The camshaft 13 includes an oil supply hole 45, which extends in the axial direction, that is, the horizontal direction as viewed in FIG. 4. The oil supply hole 45 is connected to the oil pump 21 through an oil supply passage extending through the cylinder head 12 and the cylinder block. The oil supply pipe 42 inserted in the coupling 38 is also inserted in the oil supply hole 45 of the camshaft 13. An O-ring 46 is attached to the outer circumference of each end of the oil supply pipe 42. One of the O-rings 46 seals the gap between the oil supply pipe 42 and the coupling 38, and the other seals the gap between the oil supply pipe 42 and the camshaft 13.

Figure 5:
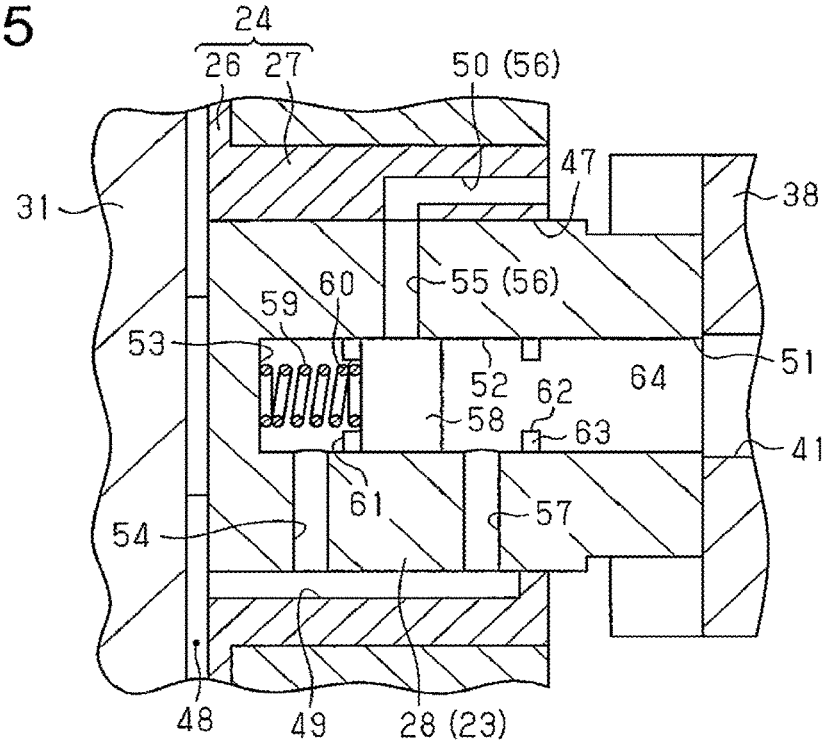
FIG. 5 is a partial enlarged cross-sectional view showing a communication control mechanism when a valve is in a first position.

As shown in FIG. 5, the support 27 of the housing 24 has an inner circumferential surface 47, which includes an oil supply groove 49 and a communication hole 50. The oil supply groove 49 extends in the axial direction, that is, the horizontal direction as viewed in FIG. 5, and communicates with a vacuum chamber 48. The communication hole 50 includes an open end that opens in the atmosphere and an open end that opens in the inner circumferential surface 47.

The shaft 28 of the rotor 23 includes an accommodation hole 52 extending in the axial direction. The accommodation hole 52 includes an opening 51 connected to the insertion passage 41 of the coupling 38. The oil supply pipe 42 provides communication between the insertion passage 41 and the oil supply hole 45 of the camshaft 13, which is connected to the oil pump 21. That is, the accommodation hole 52 is connected to the oil pump 21 through the opening 51. The accommodation hole 52 does not extend through the rotor 23 in the axial direction and includes an end wall 53.

The accommodation hole 52 is connected to a first through hole 54, which extends from the accommodation hole 52 in the radial direction, that is, the vertical direction as viewed in FIG. 5. The first through hole 54 opens in the outer circumferential surface of the rotor 23, providing communication between the accommodation hole 52 and the oil supply groove 49. A section of the accommodation hole 52 between the first through hole 54 and the opening 51 is connected to a second through hole 55, which extends in the radial direction from the accommodation hole 52. The second through hole 55 opens in the outer circumferential surface of the rotor 23, providing communication between the accommodation hole 52 and the communication hole 50. The second through hole 55 and the communication hole 50 form an atmosphere communication passage 56, which introduces air into the vacuum pump 10.

Further, a section of the accommodation hole 52 between the second through hole 55 and the opening 51 is connected to a third through hole 57, which extends in the radial direction from the accommodation hole 52. The third through hole 57 opens in the outer circumferential surface of the rotor 23, providing communication between the accommodation hole 52 and the oil supply groove 49. As shown in FIG. 5, the first through hole 54 and the third through hole 57 extend in the same direction from the accommodation hole 52. Thus, when the first through hole 54 provides communication between the accommodation hole 52 and the oil supply groove 49, the third through hole 57 also provides communication between the accommodation hole 52 and the oil supply groove 49. The second through hole 55 is positioned to provide communication between the accommodation hole 52 and the communication hole 50 when the accommodation hole 52 communicates with the oil supply groove 49. As a result, when the second through hole 55 communicates with the communication hole 50 and the accommodation hole 52, the communication hole 50 communicates with the oil supply groove 49 through the second through hole 55, the accommodation hole 52, and the first through hole 54.

The accommodation hole 52 accommodates a valve 58, which is slidable in the axial direction, and a compressed spring 59, which is placed between the valve 58 and the end wall 53 and urges the valve 58 toward the opening 51. An annular first stopper 61 is fixed in the accommodation hole 52 between the first through hole 54 and the second through hole 55. The first stopper 61 has an insertion hole 60 at the center. Further, an annular second stopper 63 is fixed in the accommodation hole 52 between the third through hole 57 and the opening 51. The second stopper 63 has an insertion hole 62 at the center. The valve 58 is located between the first stopper 61 and the second stopper 63 in the axial direction. The spring 59 is inserted through the insertion hole 62 of the first stopper 61 and connected to the valve 58.

The valve 58 divides the accommodation hole 52 into a section that faces the opening 51 and a section that faces the end wall 53. The section of the accommodation hole 52 between the valve 58 and the opening 51 functions as an oil introduction passage 64.

The opening 51 of the accommodation hole 52 is connected to the oil pump 21. Thus, when the internal combustion engine 11 is operated, the oil pump 21 draws and supplies oil to the oil introduction passage 64 of the accommodation hole 52. The pressure of the oil supplied to the oil introduction passage 64 applies force to the valve 58. When this force exceeds the urging force of the spring 59, the valve 58 moves against the urging force of the spring 59 and into contact with the first stopper 61. As shown in FIG. 5, the valve 58 closes the second through hole 55 when in contact with the first stopper 61. In this state, the oil introduction passage 64 communicates with the third through hole 57. The valve 58 is thus placed in a first position, where the third through hole 57 intermittently communicates with the oil supply groove 49 when the internal combustion engine 11 is operated and rotates the rotor 23. The oil supply groove 49 provides communication between the oil introduction passage 64 and the vacuum chamber 48, introducing oil into the vacuum pump 10.

Figure 6:
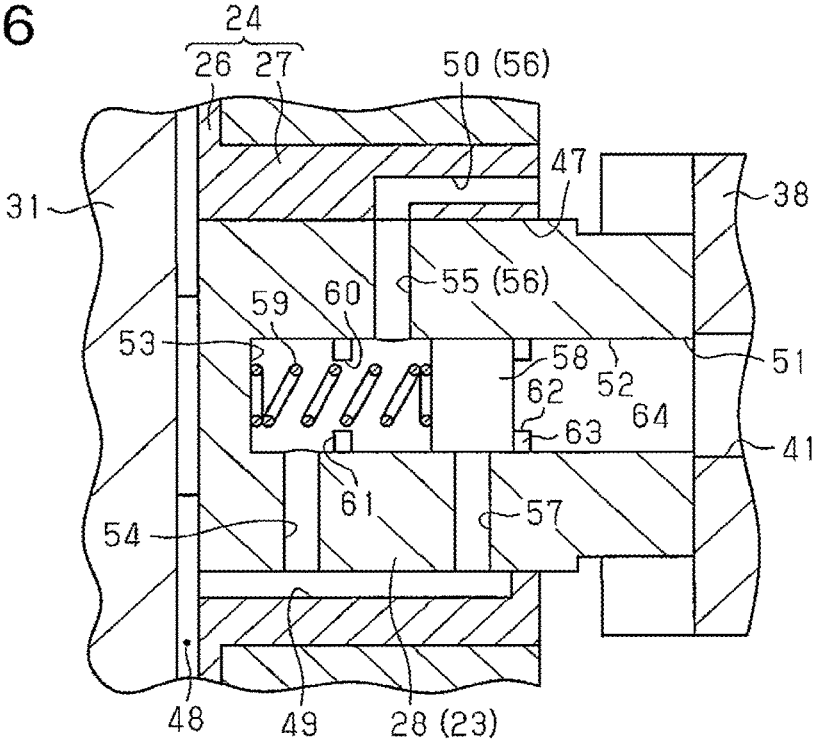
FIG. 6 is a partial enlarged cross-sectional view showing the communication control mechanism when the valve is in a second position.

When the force acting on the valve 58, which is generated by the pressure of the oil supplied to the oil introduction passage 64, becomes less than the urging force of the spring 59, the urging force of the spring 59 moves the valve 58 into contact with the second stopper 63. As shown in FIG. 6, the valve 58 closes the third through hole 57 when in contact with the second stopper 63. In this state, the oil introduction passage 64 does not communicate with any of the through holes and is closed. In addition, the section of the accommodation hole 52 between the valve 58 and the end wall 53 provides communication between the second through hole 55 and the first through hole 54. This introduces air into the vacuum pump 10 through the atmosphere communication passage 56. The valve 58 and the spring 59 form a communication control mechanism that uses oil pressure to switch between a state where the vacuum chamber 48 communicates with the oil introduction passage 64 and the atmosphere communication passage 56 is closed as shown in FIG. 5, and a state where the vacuum chamber 48 communicates with the atmosphere communication passage 56 and the oil introduction passage 64 is closed as shown in FIG. 6. In the following descriptions, the position of the valve 58 when in contact with the first stopper 61 is referred to as the first position, and the position of the valve 58 when in contact with the second stopper 63 is referred to as the second position.

Referring to FIGS. 5 and 6, the operation of the vacuum pump 10 will now be described.

As shown in FIG. 5, when the vacuum pump 10 is driven and the pressure of the oil supplied to the oil introduction passage 64 from the oil pump 21 is high, the valve 58 is placed in the first position and closes the second through hole 55, which forms the atmosphere communication passage 56 with the communication hole 50. In this state, the oil introduction passage 64 communicates with the vacuum chamber 48 through the third through hole 57 and the oil supply groove 49. That is, the atmosphere communication passage 56 is closed, and the oil introduction passage 64 communicates with the vacuum chamber 48. This state limits introduction of air into the vacuum chamber 48 through the atmosphere communication passage 56 while allowing supply of oil into the vacuum chamber 48 through the oil introduction passage 64 during operation of the vacuum pump 10. Thus, the amount of air discharged from the vacuum pump 10 and air discharge noises are limited while vacuum pump 10 is lubricated.

In the process of stopping the vacuum pump 10, the amount of oil supplied from the oil pump 21 decreases, lowering the oil pressure in the oil introduction passage 64. When the force generated by the oil pressure in the oil introduction passage 64 becomes less than the urging force of the spring 59, the valve 58 moves to the second position as shown in FIG. 6. This brings the second through hole 55, which forms the atmosphere communication passage 56 with the communication hole 50, into communication with the first through hole 54 through the accommodation hole 52. Since the first through hole 54 communicates with the oil supply groove 49, which communicates with the vacuum chamber 48, the vacuum chamber 48 is brought into communication with the atmosphere communication passage 56, and the oil introduction passage 64 is closed. In the process of stopping the vacuum pump 10, the rotor 23 still rotates, intermittently allowing communication between the vacuum chamber 48 and the atmosphere communication passage 56. This supplies the vacuum pump 10 with air and releases the negative pressure remaining in the vacuum chamber 48.

When the vacuum pump 10 is stopped, the valve 58 closes the third through hole 57, and the oil introduction passage 64 is closed. Thus, even if negative pressure still remains in the vacuum chamber 48 when the vacuum pump 10 is stopped, oil is not drawn into the vacuum chamber from the oil introduction passage 64. If the rotor 23 is stopped in the position that provides communication between the vacuum chamber 48 and the atmosphere communication passage 56 when the vacuum pump 10 is stopped, air flows into the vacuum chamber 48 through the atmosphere communication passage 56, releasing the negative pressure in the vacuum chamber 48. If the rotor 23 is stopped in the position that closes communication between the vacuum chamber 48 and the atmosphere communication passage 56 when the vacuum pump 10 is stopped, air flows into the vacuum chamber 48 through the gap between the outer circumferential surface of the shaft 28 of the rotor 23 and the inner circumferential surface 47 of the support 27 of the housing 24, releasing the negative pressure in the vacuum chamber 48.

As shown in FIG. 6, when the vacuum pump 10 is stopped, the valve 58 closes the communication between the oil introduction passage 64 and the atmosphere communication passage 56. This limits entry of air into the oil introduction passage 64 through the atmosphere communication passage 56 when the vacuum pump 10 is stopped. Thus, the oil remaining in the oil introduction passage 64, the insertion passage 41, and the oil supply hole 45 is less likely to be discharged by its own weight. This maintains the oil in the oil introduction passage 64 when the vacuum pump 10 is stopped. The oil remaining in the oil introduction passage 64 can be promptly supplied to the vacuum pump 10 on the next actuation of the vacuum pump 10. In addition, this structure allows for prompt increase in the oil pressure in the oil introduction passage 64 when the vacuum pump 10 is actuated, allowing the oil pressure to promptly move the valve 58 of the communication control mechanism to the first position. This promptly starts lubrication and limits drawing of air into the vacuum chamber 48 through the atmosphere communication passage 56, enabling prompt generation of negative pressure.

The valve 58 and the spring 59 form the communication control mechanism. Depending on the pressure of the oil supplied to the oil introduction passage 64, the valve 58 is movable between the first position for closing the second through hole 55 and the second position for closing the third through hole 57. This structure is simpler than a structure with an additional mechanism to operate the valve 58, thus allowing reduction in the size of the vacuum pump 10.

The advantages of the present embodiment will now be described.

(1) The vacuum pump 10 includes the communication control mechanism. When the vacuum pump 10 is driven, the communication control mechanism provides communication between the vacuum chamber 48 and the oil introduction passage 64 and closes the atmosphere communication passage 56. When the vacuum pump 10 is stopped, the communication control mechanism provides communication between the vacuum chamber 48 and the atmosphere communication passage 56 and closes the oil introduction passage 64. This limits drawing of oil into the vacuum pump 10 from the oil introduction passage 64 when the vacuum pump 10 is stopped. Further, discharge of oil from the oil introduction passage 64 by the weight of oil is limited when supply of oil from the oil pump 21 is stopped. This increases the probabilities that oil remains in the oil introduction passage 64 when the vacuum pump 10 is stopped. As a result, when the vacuum pump 10 is actuated again, the oil remaining in the oil introduction passage 64 can be promptly supplied to the vacuum pump 10. As such, drawing of oil into the vacuum chamber 48 is limited when the vacuum pump 10 is stopped, and lubrication promptly starts when the vacuum pump 10 is actuated.

(2) The valve 58 and the spring 59 form the communication control mechanism. Depending on the pressure of the oil supplied to the oil introduction passage 64, the valve 58 is movable between the first position for closing the second through hole 55 and the second position for closing the third through hole 57. When the vacuum pump 10 is stopped, the valve 58 closes the oil introduction passage 64. This maintains oil in the oil introduction passage 64 when the vacuum pump 10 is stopped. Thus, when oil is supplied to the oil introduction passage 64 through the oil pump 21 on the next actuation of the vacuum pump 10, the oil pressure in the oil introduction passage 64 will promptly increase and move the valve 58 to the first position. Therefore, in addition to promptly starting lubrication, the structure limits drawing of air into the vacuum chamber 48 through the atmosphere communication passage 56, achieving prompt generation of negative pressure.

The present embodiment may be modified as follows.

The first stopper 61 and the second stopper 63 in the accommodation hole 52 may be omitted. In this case, the valve 58 may be held in the first position and the second position by adjusting the compressed length and the expanded length of the spring 59.

Figure 7:
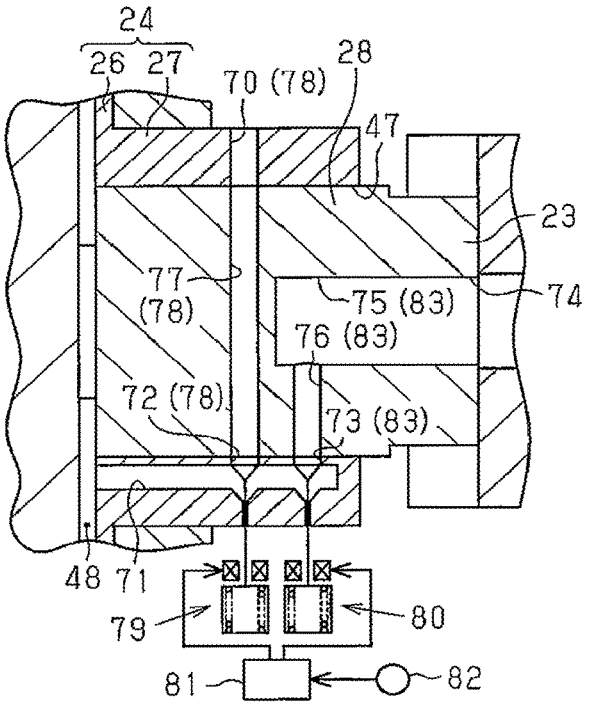
FIG. 7 is a cross-sectional view showing a communication control mechanism of another embodiment.
Figure 8:
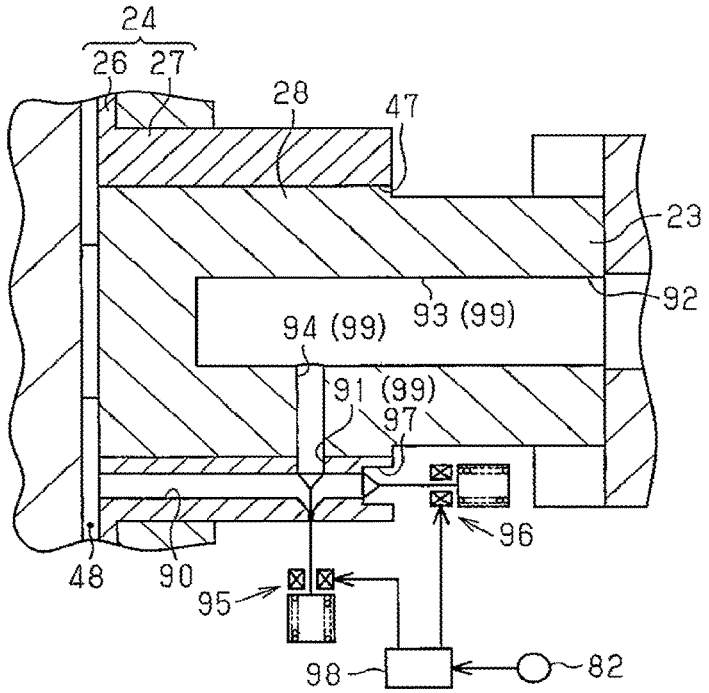
FIG. 8 is a cross-sectional view showing a communication control mechanism of a further embodiment.

The communication control mechanism may be modified as shown in FIGS. 7 and 8.

FIG. 7 shows a vacuum pump that includes a communication hole 70 and an oil supply hole 71 in the support 27 of the housing 24. The communication hole 70 extends in the radial direction and includes an open end that opens in the atmosphere and an open end that opens in the inner circumferential surface 47 of the housing 24. The oil supply hole 71 extends in the axial direction and communicates with the vacuum chamber 48. The oil supply hole 71 includes a first open hole 72 and a second open hole 73, which are separated from each other in the axial direction. The first and second open holes 72 and 73 extend in the radial direction and open in the inner circumferential surface 47 of the housing 24.

The shaft 28 of the rotor 23, which is supported by the support 27 of the housing 24, includes an oil introduction hole 75 extending in the axial direction. The oil introduction hole 75 includes an opening 74 connected to the oil pump 21. A second through hole 76 extends in the radial direction from the oil introduction hole 75. The second through hole 76 opens in the outer circumferential surface of the rotor 23 and communicates with the second open hole 73. The second through hole 76, the oil introduction hole 75, and the second open hole 73 form an oil introduction passage 83. The section of the shaft 28 between the oil introduction hole 75 and the vacuum chamber 48 includes a first through hole 77, which extends through the shaft 28 in the radial direction. The first through hole 77 provides communication between the communication hole 70 and the first open hole 72. The first through hole 77, the communication hole 70, and the first open hole 72 form an atmosphere communication passage 78.

A first solenoid valve 79 for closing and opening the first open hole 72 and a second solenoid valve 80 for closing and opening the second open hole 73 are located in the oil supply hole 71. The vacuum pump 10 includes a controller 81, which receives output signals from an ignition switch 82. In response to the output signals, the controller 81 controls the first solenoid valve 79 and the second solenoid valve 80. Specifically, in a period between when the ignition switch 82 is turned ON from OFF and when the ignition switch 82 is turned OFF from ON, the controller 81 controls the first solenoid valve 79 to close the first open hole 72 and controls the second solenoid valve 80 to open the second open hole 73. Thus, when the internal combustion engine 11 is operated and the vacuum pump 10 is driven, the vacuum chamber 48 communicates with the oil introduction passage 83 through the oil supply hole 71, and the atmosphere communication passage 78 is closed.

In contrast, during the period between when the ignition switch 82 is turned OFF from ON and when the ignition switch 82 is turned ON from OFF, the controller 81 controls the first solenoid valve 79 to open the first open hole 72 and controls the second solenoid valve 80 to close the second open hole 73. Thus, when the internal combustion engine 11 and the vacuum pump 10 are stopped, the vacuum chamber 48 communicates with the atmosphere communication passage 78 through the oil supply hole 71, and the oil introduction passage 83 is closed.

In the structure described above, when the vacuum pump 10 is driven, the first solenoid valve 79, the second solenoid valve 80, and the controller 81 provide communication between the vacuum chamber 48 and the oil introduction passage 83 and closes the atmosphere communication passage 78. When the vacuum pump 10 is stopped, the vacuum chamber 48 communicates with the atmosphere communication passage 78, and the oil introduction passage 83 is closed. The first solenoid valve 79, the second solenoid valve 80, and the controller 81 form a communication control mechanism.

FIG. 8 shows a vacuum pump that includes an introduction hole 90 in the support 27 of the housing 24. The introduction hole 90 extends in the axial direction and includes an open end that opens in the atmosphere and an open end that communicates with the vacuum chamber 48. A communication hole 91 extends from the introduction hole 90 in the radial direction. The communication hole 91 opens in the inner circumferential surface 47 of the housing 24.

The shaft 28 of the rotor 23, which is supported by the support 27 of the housing 24, includes an oil introduction hole 93 extending in the axial direction. The oil introduction hole 93 includes an opening 92 connected to the oil pump 21. The oil introduction hole 93 includes a through hole 94 extending in the radial direction. The through hole 94 opens in the outer circumferential surface of the rotor 23 and communicates with the communication hole 91. The oil introduction hole 93, the through hole 94, and the communication hole 91 form an oil introduction passage 99.

A first solenoid valve 95 for closing and opening the communication hole 91 is located in the introduction hole 90. A second solenoid valve 96 is located in the introduction hole 90 near the open end that opens in the atmosphere. The second solenoid valve 96 opens and closes communication between the introduction hole 90 and the atmosphere. The section of the introduction hole 90 between the open end that opens in the atmosphere and the area that is opened and closed by the second solenoid valve 96 forms an atmosphere communication passage 97.

The vacuum pump 10 includes a controller 98, which receives output signals from the ignition switch 82. In response to the output signals, the controller 98 controls the first solenoid valve 95 and the second solenoid valve 96. Specifically, during the period between when the ignition switch 82 is turned ON from OFF and when the ignition switch 82 is turned OFF from ON, the controller 98 controls the first solenoid valve 95 to open the communication hole 91 and controls the second solenoid valve 96 to close communication between the introduction hole 90 and the atmosphere. Thus, when the internal combustion engine 11 is operated and the vacuum pump 10 is driven, the vacuum chamber 48 communicates with the oil introduction passage 99 through the introduction hole 90, and the atmosphere communication passage 97 is closed.

In contrast, during the period between when the ignition switch 82 is turned OFF from ON and when the ignition switch 82 is turned ON from OFF, the controller 98 controls the first solenoid valve 95 to close the communication hole 91 and controls the second solenoid valve 96 to provide communication between the introduction hole 90 and the atmosphere. Thus, when the internal combustion engine 11 and the vacuum pump 10 are stopped, the vacuum chamber 48 communicates with the atmosphere communication passage 97, and the oil introduction passage 99 is closed.

In the structure described above, when the vacuum pump 10 is driven, the first solenoid valve 95, the second solenoid valve 96, and the controller 98 provide communication between the vacuum chamber 48 and the oil introduction passage 99 and close the atmosphere communication passage 97. When the vacuum pump 10 is stopped, the vacuum chamber 48 communicates with the atmosphere communication passage 97, and the oil introduction passage 99 is closed. The first solenoid valve 95, the second solenoid valve 96, and the controller 98 form a communication control mechanism.

The invention claimed is:

1. A vacuum pump comprising:

a rotor;

a housing that accommodates the rotor and rotationally supports the rotor, wherein the rotor and the housing define a vacuum chamber, and rotation of the rotor generates negative pressure in the vacuum chamber;

an oil introduction passage configured to be connected to an oil pump to introduce oil into the vacuum pump;

an atmosphere communication passage that opens in the atmosphere to introduce air into the vacuum pump; and a communication control mechanism that provides communication between the vacuum chamber and the oil introduction passage and closes the atmosphere communication passage when the vacuum pump is driven, wherein the communication control mechanism provides communication between the vacuum chamber and the atmosphere communication passage and closes the oil introduction passage when the vacuum pump is stopped, wherein the housing includes:

a support that supports the rotor;

an oil supply groove located in an inner circumferential surface of the support and communicating with the vacuum chamber; and a communication hole including an open end that opens in the atmosphere and an open end that opens in the inner circumferential surface of the support, the rotor includes a shaft supported by the support, the shaft includes:

an accommodation hole extending in an axial direction and including an opening that is configured to be connected to the oil pump;

a first through hole extending from the accommodation hole in a radial direction that is perpendicular to the axial direction, wherein the first through hole opens in an outer circumferential surface of the rotor and provides communication between the accommodation hole and the oil supply groove;

a second through hole extending in the radial direction from a section of the accommodation hole located between the first through hole and the opening, wherein the second through hole opens in the outer circumferential surface of the rotor, provides communication between the accommodation hole and the communication hole, and forms the atmosphere communication passage with the communication hole; and a third through hole extending in the radial direction from a section of the accommodation hole located between the second through hole and the opening, wherein the third through hole opens in the outer circumferential surface of the rotor and provides communication between the accommodation hole and the oil supply groove, the communication control mechanism includes:

a valve accommodated in the accommodation hole to be slidable in the axial direction, wherein the valve is movable between a first position for closing the second through hole and a second position for closing the third through hole; and a spring that urges the valve toward the opening, a section of the accommodation hole located between the valve and the opening forms the oil introduction passage, when the vacuum pump is driven and supplied with oil from the oil pump, oil pressure in the oil introduction passage moves the valve to the first position against urging force of the spring so that the valve closes the second through hole and that the oil introduction passage communicates with the oil supply groove through the third through hole, and when the vacuum pump is stopped and supply of oil from the oil pump is stopped, the urging force of the spring moves the valve to the second position so that the valve closes the third through hole and the oil introduction passage and that the first through hole communicates with the second through hole through the accommodation hole.

2. A vacuum pump comprising:

a rotor;

a housing that accommodates the rotor and rotationally supports the rotor, wherein the rotor and the housing define a vacuum chamber, and rotation of the rotor generates negative pressure in the vacuum chamber;

an oil introduction passage configured to be connected to an oil pump to introduce oil into the vacuum pump;

an atmosphere communication passage that opens in the atmosphere to introduce air into the vacuum pump; and a communication control mechanism that provides communication between the vacuum chamber and the oil introduction passage and closes the atmosphere communication passage when the vacuum pump is driven, wherein the communication control mechanism provides communication between the vacuum chamber and the atmosphere communication passage and closes the oil introduction passage when the vacuum pump is stopped, wherein the housing includes a support that supports the rotor, the support includes:

a communication hole extending in a radial direction of the housing and including an open end that opens in the atmosphere and an open end that opens in an inner circumferential surface of the support;

an oil supply hole extending in an axial direction of the housing and communicating with the vacuum chamber; and first and second open holes extending in the radial direction from positions in the oil supply hole that are separated from each other in the axial direction, the first and second open boles open in the inner circumferential surface of the support, the rotor includes a shaft supported by the support, the shaft includes:

an oil introduction hole extending in an axial direction of the rotor and including an opening configured to be connected to the oil pump;

a second through hole extending from the oil introduction hole in a radial direction of the rotor, wherein the second through hole opens in an outer circumferential surface of the shaft and communicates with the second open hole; and a first through hole located in the shaft between the oil introduction hole and the vacuum chamber, wherein the first through hole extends through the rotor in the radial direction to provide communication between the communication hole and the first open hole, the oil introduction hole, the second through hole, and the second open hole form the oil introduction passage, the communication hole, the first through hole, and the first open hole form the atmosphere communication passage, the communication control mechanism includes:

a first solenoid valve that closes and opens the first open hole;

a second solenoid valve that closes and opens the second open hole; and a controller that controls the first and second solenoid valves, when the vacuum pump is driven, the controller controls the first solenoid valve to close the first open hole and controls the second solenoid valve to open the second open hole, and when the vacuum pump is stopped, the controller controls the first solenoid valve to open the first open hole and controls the second solenoid valve to close the second open hole.

3. A vacuum pump comprising:

a rotor;

a housing that accommodates the rotor and rotationally supports the rotor, wherein the rotor and the housing define a vacuum chamber, and rotation of the rotor generates negative pressure in the vacuum chamber;

an oil introduction passage configured to be connected to an oil pump to introduce oil into the vacuum pump;

an atmosphere communication passage that opens in the atmosphere to introduce air into the vacuum pump; and a communication control mechanism that provides communication between the vacuum chamber and the oil introduction passage and closes the atmosphere communication passage when the vacuum pump is driven, wherein the communication control mechanism provides communication between the vacuum chamber and the atmosphere communication passage and closes the oil introduction passage when the vacuum pump is stopped, wherein the housing includes a support that supports the rotor, the support includes:

an introduction hole extending in an axial direction of the housing and including an open end that opens in the atmosphere and an open end that communicates with the vacuum chamber; and a communication hole extending from the introduction hole in a radial direction of the housing and opening in an inner circumferential surface of the support, the rotor includes a shaft supported by the support, the shaft includes an oil introduction hole extending in an axial direction of the rotor and including an opening configured to be connected to the oil pump, the oil introduction hole includes a through hole extending from the oil introduction hole in a radial direction of the rotor, the through hole opens in an outer circumferential surface of the shaft and communicates with the communication hole, the oil introduction hole, the through hole, and the communication hole form the oil introduction passage, the communication control mechanism includes:

a first solenoid valve that closes and opens the communication hole;

a second solenoid valve located in the introduction hole between the communication hole and the open end that opens in the atmosphere, wherein the second solenoid valve opens and closes communication between the introduction hole and the atmosphere; and a controller that controls the first and second solenoid valves, a section of the introduction hole located between an area that is opened and closed by the second solenoid valve and the open end that opens in the atmosphere forms the atmosphere communication passage, when the vacuum pump is driven, the controller controls the first solenoid valve to open the communication hole and controls the second solenoid valve to close communication between the introduction hole and the atmosphere, and when the vacuum pump is stopped, the controller controls the first solenoid valve to close the communication hole and controls the second solenoid valve to provide communication between the introduction hole and the atmosphere.

* * * * *